US007144199B2

(12) United States Patent
Bontje

(10) Patent No.: US 7,144,199 B2
(45) Date of Patent: Dec. 5, 2006

(54) RETRACTABLE DOCK

(76) Inventor: Michael P. Bontje, 71 Nautilus Ave., Northport, NY (US) 11768

( * ) Notice: Subject to any disclaimer, the term of this patent is extended or adjusted under 35 U.S.C. 154(b) by 0 days.

(21) Appl. No.: 10/930,676

(22) Filed: Sep. 1, 2004

(65) Prior Publication Data

US 2006/0045629 A1 Mar. 2, 2006

(51) Int. Cl.
*B63C 1/00* (2006.01)

(52) U.S. Cl. ..... 405/218

(58) Field of Classification Search ..... 405/4–7, 405/86, 218–221; 114/44, 263
See application file for complete search history.

(56) References Cited

U.S. PATENT DOCUMENTS 4,352,597 A * 10/1982 Kay ..... 405/219
4,505,619 A * 3/1985 Sargent ..... 405/220
4,938,629 A * 7/1990 Boudrias ..... 114/263
4,979,453 A * 12/1990 Sloan et al. ..... 114/263
4,993,341 A * 2/1991 Merkel ..... 114/61.1
5,085,165 A * 2/1992 Reed ..... 114/362
6,558,083 B1 * 5/2003 Quandt ..... 405/218
6,746,181 B1 * 6/2004 Heintz et al. ..... 405/219
6,793,039 B1 * 9/2004 Schmid, Jr. ..... 405/221
6,845,845 B1 * 1/2005 Schmid, Jr. ..... 405/218
6,926,468 B1 * 8/2005 Sehl ..... 405/219
6,942,062 B1 * 9/2005 Schmid, Jr. ..... 405/221

FOREIGN PATENT DOCUMENTS

JP 06056079 * 3/1994 ..... 405/218

* cited by examiner

*Primary Examiner*—Frederick L. Lagman

(57) ABSTRACT

The automated, rotary retractable dock will have the elevated structural skeleton of a regular or seasonal dock. This includes the pilings and cross members. The pilings will support guide rails running (track-like) between them. The pilings will also be fixed with cross bars, and rollers which will partially support the material that will serve as the dock surface as it is extended or retracted. This dock surface "material" can be a wooden, metal, or plastic, interlocking grating which will be wound up at the land-ward end of the dock/bulkhead, into a housing unit. Wheels or rollers will be placed periodically along the side of the grated decking material. On one or both ends of the structure, an electric winch will pull the dock surface material out across the structure (water-ward) and on the other end, retract it (land-ward). The system will have both land-ward and water-ward "on/off" switches and a remote control.

6 Claims, 2 Drawing Sheets

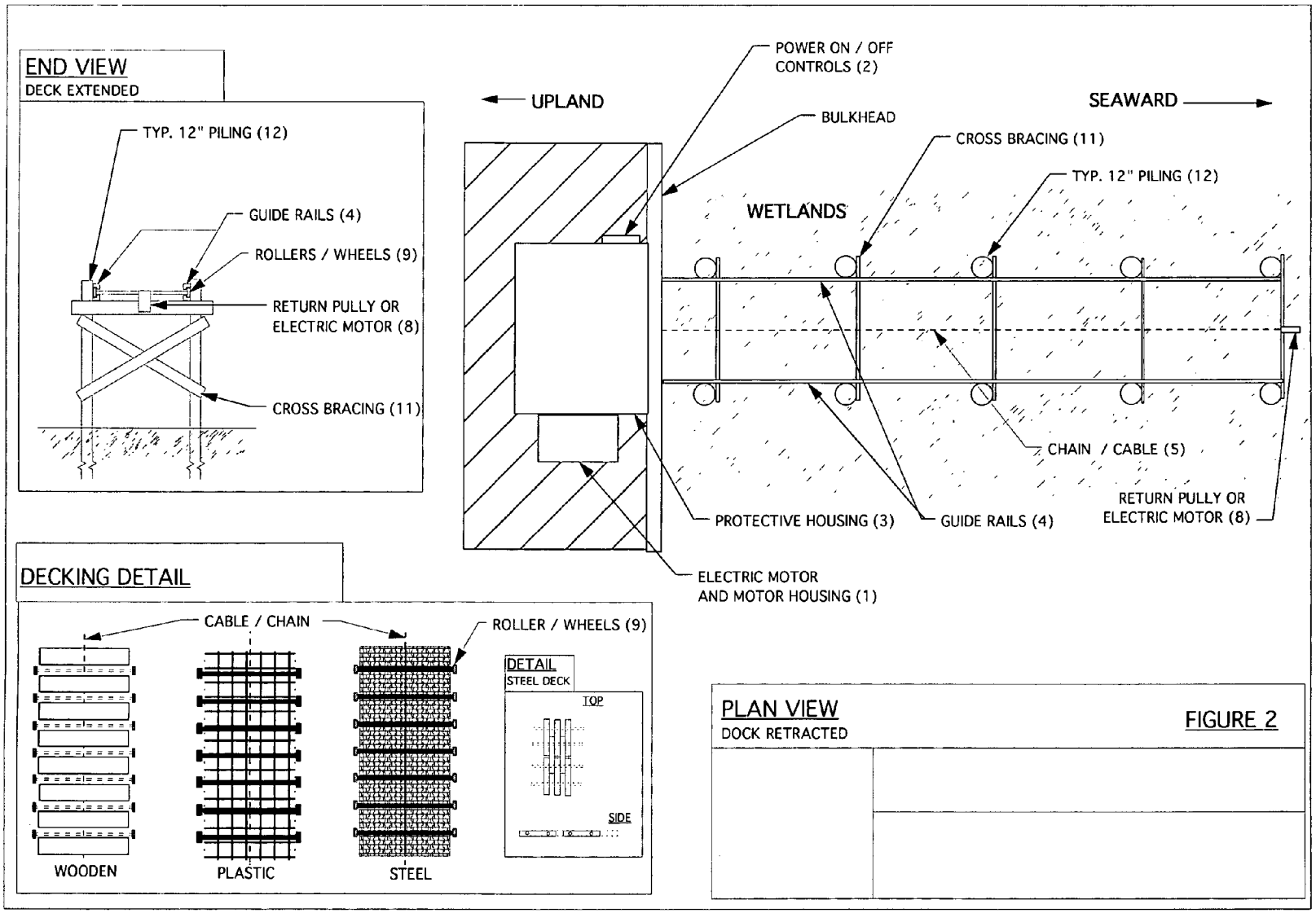
SEAWARD
UPLAND
POWER ON / OFF CONTROLS (2)
BULKHEAD
CROSS BRACING (11)
TYP. 12" PILING (12)
WETLANDS
GUIDE RAILS (4)
CHAIN / CABLE (5)
RETURN PULLY OR ELECTRIC MOTOR (8)
PROTECTIVE HOUSING (3)
ELECTRIC MOTOR AND MOTOR HOUSING (1)
PLAN VIEW
DOCK RETRACTED
FIGURE 2
END VIEW
DECK EXTENDED
TYP. 12" PILING (12)
GUIDE RAILS (4)
ROLLERS / WHEELS (9)
RETURN PULLY OR ELECTRIC MOTOR (8)
CROSS BRACING (11)
DECKING DETAIL
CABLE / CHAIN
ROLLER / WHEELS (9)
DETAIL
STEEL DECK
TOP
SIDE
STEEL
PLASTIC
WOODEN

RETRACTABLE DOCK

BACKGROUND OF THE INVENTION

A major reason for rejection of docks accessing navigable waters is environmental impacts due to the shading of the underlying marine or aquatic submerged aquatic vegetation. The rotary, retractable dock is a design which allows a dock to have "temporary" and partial shading effect during the growing season. The dock is made to be "coiled" and "retracted" in a housing on adjacent uplands so that the dock is not shading vegetation or sea life for any extended period of time. This allows vegetation, which is photosensitive, to obtain the light it needs to grow and thrive. Thus, the rotary, automated, retractable dock allows a waterfront property owner, wishing to access the water, an option to do so without putting a significant stress on the surrounding environment through shading of the submerged aquatic vegetation. The land-based housing provides a protected, compact and discrete/attractive storage for the decking material when not in use.

Prior art made known to the inventor varies from the current invention as follows:

Sloan (U.S. Pat. No. 4,979,543) provides a floating, modular lock system. It is not rotary in storage configuration, is not retractable automatically to the land-ward side, is not on side wheels or rollers and is not provided with a protective housing.

Boundrias (U.S. Pat. No. 4,938,629) provides a concrete floating dock system which can be sunk or raised as needed. It is not automatically retracted, is not stored to the land-ward side, is not on side wheels or rollers and is not provided with a protective housing.

Kay (U.S. Pat. No. 4,352,597) provides an elevated dock system which can be assembled and disassembled only by hand. The decking lacks wheels or rollers. It is not automatically extended or retracted, is not stored to the land-ward side and is not provided with a protective housing.

Heintz (U.S. Pat. No. 6,746,181-B1) provides an elevated dock system which consists of a series of flat panels on legs driven in and out of the water by an elective motor on a geared assembly. This art varies from the instant application in that it lacks, (1) side guide rails/flanges, (2) a pulley/cable assembly for extension and retraction, (3) a rotary configuration, (4) a land-ward housing, (5) a series of side wheels attached to the decking material itself and (6) a remote control device. Further, it is not fully automated as is requires hand placement of joint decking pins or bolts for the decking and hand extension of "legs" to the lake on sea floor. The retraction process will require the same hand work.

A SUMMARY OF THE INVENTION

The attached drawings show the intention of the concept. The dock will have the elevated structural skeleton of a regular or seasonal dock. This includes the pilings and cross members. The pilings will support guide rails running (track like) between them. The guide rails will have a series of flanges to support side-facing decking wheels, allow extension and retraction of the decking material and yet, prevent upward, down-ward or lateral movement of the same decking material. The pilings will also be fixed with cross bars, and possibly roll bars which will partial support the material that will also serve as the dock surface as it is extended or retracted. This dock surface "material" can be a wooden slats, metal grating or plastic grating which will be wound up at the end of the dock/bulkhead, in a housing unit. Wheels will be spaced periodically along side of the decking material. On either end of the structure will be an electric winch attached to a cable or chain and pulley assembly, the (water-ward winch) will pull the dock surface material out across the structure and, on the other end, the land-ward winch will retract it into the land-based housing.

BRIEF DESCRIPTION OF THE DRAWINGS

FIG. 1 shows the cable or chain (5) and possible pulley (8) assembly which will extend or retract the decking (7) along the side-facing to guide rails (4). This drawing also details the specifications of the support and guide rails (4) and illustrates how the deck (7) will sit upon and be guided by and move across the structure. FIG. 2, labeled Retractable Decking Material—specifically illustrates in section view the storage house (3) and how the decking (7) will be coiled and extended. It also details the movement of the roller bearings/wheels (9) along the guide rails (4), the deck support rollers (10) and cross bracing (11). It also illustrates how the decking will be extended on retracted by the electric winches (1) and/or return pulley (8) with cable or chain assembly (5).

DETAILED DESCRIPTION OF THE INVENTION

Figure 1:
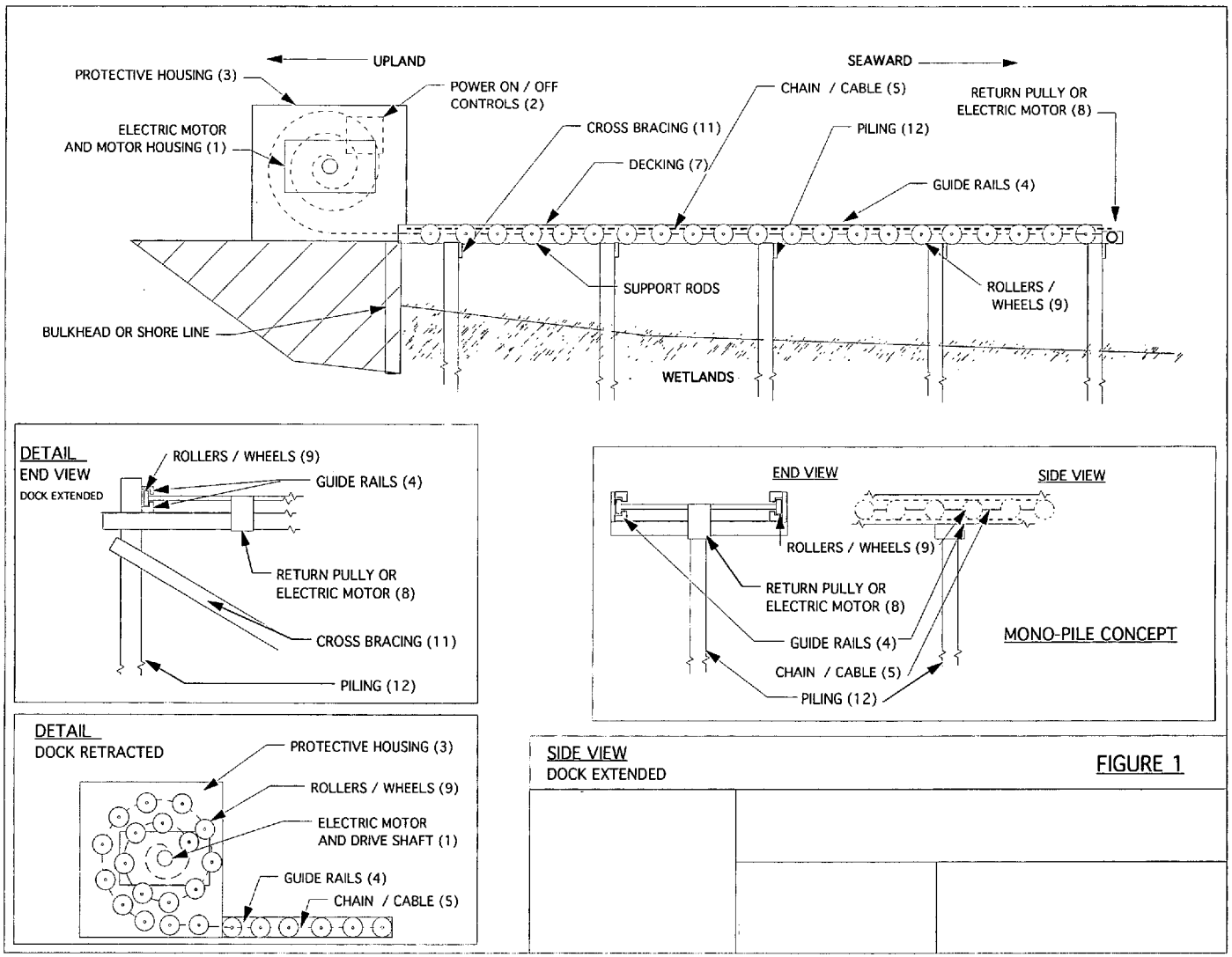
In FIG. 1, labeled Supporting Structure, Housing & Motors—illustrates in section view the elevated "skeleton" structure specifying the pilings (12 and 13), distances between them, install of the side-facing guide rails (4) as a track for the roller bearings/wheels (9). Also shown is the housing unit (3) for the decking material (7), the electric winch (1) or pulley (8) at the seaward end of the structure and the motor connection to the land-ward end. Electrical "on/off" switches (2 and 6) with remote control will be provided at either end of the structure. Finally.

The invention begins with construction of a dock in traditional (12) or mono-pole (13) forms. In traditional form, pilings will be paired at 8 to 10 foot intervals beginning at the land-ward side of the water line, occurring every 8 to 10 feet and extending to the desired length. The width between piling pairs will be set to the desired deck material width. The pilings will have cross members (11) at each pair (with a centered roller). The deck roller (10) centered on each cross bar shall partially support both the grated deck surface material and cable(s) extending from the electric winch (1). A side-facing guide rail (4) will be attached to the inner side of the paired pilings. The guide rails will consist of one pair of parallel, evenly spaced, facing side channels each including an inward upper flange with a downward flange extension and an inward lower flange with an upward flange extension. These will be set level with each other. An electric winch will be set and wired at the landward and possibly the water-ward end of the dock. An in/out-on/off switch (2) and/or remote control receiver will be set or the landward and water-ward end of the dock and wired to the winches. The water-ward winch shall be able to be disengaged to run "free" when the decking material is being retracted. The land-ward winch will be set to run "free" when the water-ward winch extends the decking material. The cable or chain (5) from the winch will be provided to extend the length of the dock and will be attached to the water-ward end of the deck material to allow the deck material's water-ward extension. The system may alternately be configured to include a land-side electric winch with a pulley (en lieu of a water-ward winch) on the water side and a return cable to both extend and retract the decking. The parallel piling series may be replaced by a monopole series of pilings (see FIG. 1). Each side piling will support a "T" crossbar with the guide rails set on top as above. Spacing shall be 8 to 10 feet as above. The water ward winch (or pulley) shall be set as above.

The deck material (7) will be a series of attached wood slats, metal grates or plastic grates. This is necessary to allow light to penetrate through the decking when it is temporarily in place. The grates may or may not be interlocking. Each grate or slat will also have rollers or wheels on its side spaced every 4 to 12 inches along its length. The wheels or rollers will be sized and set to extend into and rest upon the aforementioned side-facing guide rails (see FIG. 1—"Front View" and FIG. 2). The grated surface materials will be attached to each other and to the cable from the water-ward winch/pulley and will be directly attached to the land-ward winch. The two winches will be alternately turned on or off to either extend (using the water-ward or land-ward winch) or retract (using the land-ward winch) the dock. Both directions will be controlled by the on/off (6) switches and/or remote controls.

The land ward side of the invention shall consist of a housing (3) for the grated deck surface material and the land-ward electric winch. The housing shall be of a variable size according to the deck's length and width. It shall be waterproof, with a flapped opening toward the water-ward side. Maintenance access panels shall be added as needed. An electric winch will be set to drive a central axel within the land-ward housing. An in/out-on/off switch and/or remote control receiver will be set on the land-ward end of the dock surface material housing and wired to the landward winch. The land-ward winch shall extended or retract the decking but will also be able to be disengaged to run "free" when the decking material is being extended in the configuration where a water-ward winch is used. The land-ward winch will also be provided a disengage switch to allow the decking material to be extended and a hand crank to supplement or replace the electric winch for retracting the decking material in an un-powered condition.

The land-ward housing and winch shall have a cable extending the desired length of the dock and threaded through each of the grated deck surface materials. This cable and winch will be in the "free" disengaged position to allow the dock to extend outward with the deck materials when a water-ward winch is used and then be used to extract same by pulling the material back into the land-ward housing. The system may also be configured (especially with smaller docks) with a pulley at the water-ward end and a return cable/chain to the land-ward this arrangement would use only the land-ward winch to both "push" the deck material water ward and "pull" it back into the land-ward housing.

A person understanding this invention may now conceive of alternative structures and embodiments or variations of the above rotary, fully automated, retractable dock which are intended fall within the scope of the invention as defined in the claims and description above. are defined as follows:

The embodiments of the invention in which an exclusive property or privilege is claimed:

1. A rotary, retractable fully automated dock for servicing residential or commercial watercraft, the dock comprising:

a plurality of pilings;

a pair of guide rails attached to the plurality of pilings;

a grated decking having side rollers and/or wheels, wherein the guide rails are adapted to receive the grated decking to allow the grated decking to be retracted or to be extended; and a protective housing for the retracted decking and electrical motors and assemblies to allow for automatic extension and retraction.

2. The dock of claim 1, wherein the grated decking comprises a series of interlocking grating decking on side wheels or rollers.

3. The dock of claim 1 wherein the guide rails comprise a pair of side-facing channels including an upper flange with a downward extension and a lower flange with an upward extension, wherein the upper flange with downward extension prevents upward movement of the dock and the lower flange with an upward extension supports the decking, and wherein the flange extensions prevents lateral movement of the decking.

4. The dock of claim 1, wherein the dock further comprises one land-ward and one water-ward electrical switch with a remote control.

5. The dock of claim 1, wherein the dock further comprises one retraction and extension cable or chain and water-ward pulley assembly.

6. The dock of claim 5, wherein the motor comprises at least one reversible electric motor attached to the cable or chain and pulley assembly.

* * * * *